US006880627B2

(12) United States Patent
Sanada et al.

(10) Patent No.: US 6,880,627 B2
(45) Date of Patent: Apr. 19, 2005

(54) REFRIGERANT CONDENSER USED FOR AUTOMOTIVE AIR CONDITIONER

(75) Inventors: Ryouichi Sanada, Obu (JP); Michiyasu Yamamoto, Chiryu (JP); Yoshifumi Aki, Kariya (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 09/733,140

(22) Filed: Dec. 8, 2000

(65) Prior Publication Data

US 2001/0004935 A1 Jun. 28, 2001

(30) Foreign Application Priority Data

Dec. 9, 1999 (JP) ..... 11-350719

(51) Int. Cl.[7] ..... F28D 1/00
(52) U.S. Cl. ..... 165/152; 165/177
(58) Field of Search ..... 165/152, 153, 165/177, 166, 173, 150

(56) References Cited

U.S. PATENT DOCUMENTS

| | | | | |
|---|---|---|---|---|
| 4,492,268 A | * | 1/1985 | Uehara et al. | 165/166 |
| 4,790,372 A | * | 12/1988 | Gemeinhardt et al. | 165/173 |
| 4,825,941 A | * | 5/1989 | Hoshino et al. | 165/153 |
| 4,932,469 A | | 6/1990 | Beatenbough | |
| 4,998,580 A | | 3/1991 | Guntly et al. | |
| 5,251,692 A | * | 10/1993 | Haussmann | 165/152 |
| 5,307,870 A | * | 5/1994 | Kamiya et al. | 165/173 |
| 5,311,935 A | * | 5/1994 | Yamamoto et al. | 165/153 |
| 5,329,988 A | * | 7/1994 | Juger | 165/152 |
| 5,372,188 A | * | 12/1994 | Dudley et al. | 165/152 |
| 5,553,377 A | | 9/1996 | Hirano et al. | |
| 5,564,497 A | * | 10/1996 | Fukuoka et al. | 165/152 |
| 5,567,493 A | | 10/1996 | Imai et al. | |
| 5,682,944 A | | 11/1997 | Yamamoto et al. | |
| 5,730,212 A | | 3/1998 | Yamamoto et al. | |
| 5,771,964 A | * | 6/1998 | Bae | 165/177 |
| 6,000,467 A | * | 12/1999 | Tokizaki et al. | 165/177 |
| 6,003,592 A | | 12/1999 | Yamamoto et al. | |
| 6,339,937 B1 | * | 1/2002 | Makihara et al. | 62/503 |

FOREIGN PATENT DOCUMENTS

| | | | |
|---|---|---|---|
| JP | 63-243688 | | 10/1988 |
| JP | 3-204595 | | 12/1989 |
| JP | 03102193 | * | 4/1991 |
| JP | 9-303989 | | 11/1997 |
| JP | 11-230686 | | 8/1999 |

OTHER PUBLICATIONS

Japanese Office Action dated Sep. 30, 2003 regarding Japanese Patent Application No. 11–350719.

Office Action dated Jun. 28, 2004 from DE Application No. 100 60 104.9 with translation.

* cited by examiner

*Primary Examiner*—Ljiljana Ciric
(74) *Attorney, Agent, or Firm*—Harness, Dickey & Pierce, PLC

(57) ABSTRACT

A tube inside passage height (Tr) is set within a range of 0.35–0.8 mm. Thereby, sum of radiation performance reduction due to pressure loss inside tube and radiation performance reduction due to air flow resistance is reduced, thereby attaining high radiation performance. Especially, when the tube inside passage height (Tr) is set within a range of 0.5–0.7 mm, the radiation performance is further improved.

9 Claims, 7 Drawing Sheets

REFRIGERANT CONDENSER USED FOR AUTOMOTIVE AIR CONDITIONER

CROSS REFERENCE TO RELATED APPLICATION

This application is based on and incorporates herein by reference Japanese Patent Application No. Hei. 11-350719 filed on Dec. 9, 1999.

BACKGROUND OF THE INVENTION

1. Field of the Invention

The present invention relates to a refrigerant condenser, through which gas-liquid two phase refrigerant flows, suitable for use in a automotive air conditioner.

2. Description of Related Art

U.S. Pat. No. 4,998,580 discloses a multi-flow type refrigerant condenser including a plurality of tubes and fins laminated between a pair of header tanks. In U.S. Pat. No. 4,998,580, equivalent diameter of a refrigerant passage inside tube is set within a particular range for improving the radiation performance of the multi-flow type refrigerant condenser. U.S. Pat. No. 4,932,469 discloses a rib formed on a plate of a tube. The rib protrudes toward the inside of the tube. U.S. Pat. No. 5,682,944, U.S. Pat. No. 6,003,592 and U.S. Pat. No. 5,730,212 disclose that a condensing length is set within a particular range.

However, in these prior arts, only heat transfer efficiency inside the tube is considered. That is, neither air flow resistance nor pressure loss inside tube are considered for improving the radiation performance of the refrigerant condenser.

SUMMARY OF THE INVENTION

An object of the present invention is to improve a radiation performance while considering air-flow resistance and pressure loss inside tube.

In the present invention, a state where an optimum radiation performance is attained is simulated while considering the air-flow resistance and the pressure loss inside tube.

According to a first aspect of the present invention, a tube inside passage height (Tr) is set within a range of 0.35–0.8 mm. Thereby, sum of radiation performance reduction due to the pressure loss inside tube and radiation performance reduction due to the air flow resistance is reduced, thereby attaining high radiation performance. Especially, when the tube inside passage height (Tr) is set within a range of 0.5–0.7 mm, the radiation performance is further improved.

According to a second aspect of the present invention, air flow opening ratio (Pr) is set in accordance with following formula expression, $$0.1429\times Td^2+0.1343\times Td+0.139\geqq Pr\geqq 0.1429\times Td^2+0.1343\times Td+0.113.$$

Here, Td is a dimension between an outer surface of the tube and a top of the refrigerant passage in the tube lamination direction. Pr is a ratio of tube height Th to tube pitch Tp (Th/Tp). Th is a height of the tube in the tube lamination direction. Tp is an interval between each of the adjacent tubes. Thereby, sum of radiation performance reduction due to the pressure loss inside tube and radiation performance reduction due to the air flow resistance is further reduced, thereby attaining much higher radiation performance.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

Figure 1:
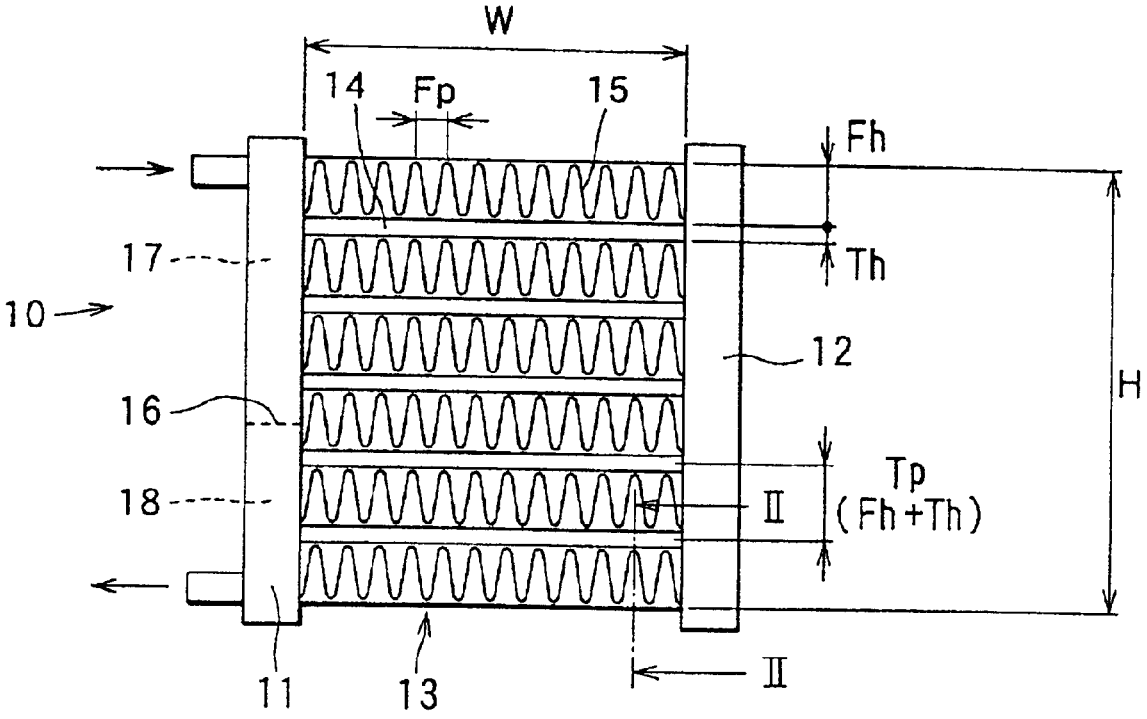
FIG. 1 is a front view showing a condenser of the present invention.

FIG. 1 shows an entire structure of a refrigerant condenser 10 used for an automotive air conditioner. The condenser 10 cools and condenses high temperature and high pressure refrigerant discharged from a compressor (not illustrated) of a refrigerant cycle for the automotive air conditioner. The condenser 10 is disposed at the front most area, in front of an engine cooling radiator, in a vehicle engine compartment. Cooling air (external air) generated by a cooling fan commonly used for the engine cooling radiator cools the condenser 10.

The condenser 10 includes first and second header tanks 11 and 12 located to have a predetermined distance therebetween. The first and second header tanks 11 and 12 substantially cylindrically extend in a vertical direction. A heat exchanging core portion 13 is disposed between the first and second header tanks 11 and 12.

The condenser 10 in the present embodiment is a multi-flow type condenser. A plurality of aluminum flat tubes 14 are vertically laminated within the core portion 13. The refrigerant flows through the flat tubes 14 between the first and second header tanks 11 and 12. An aluminum corrugate fin 15 is provided between each of the tubes 14 to promote a heat-exchange between the refrigerant and the cooling air.

Figure 2:
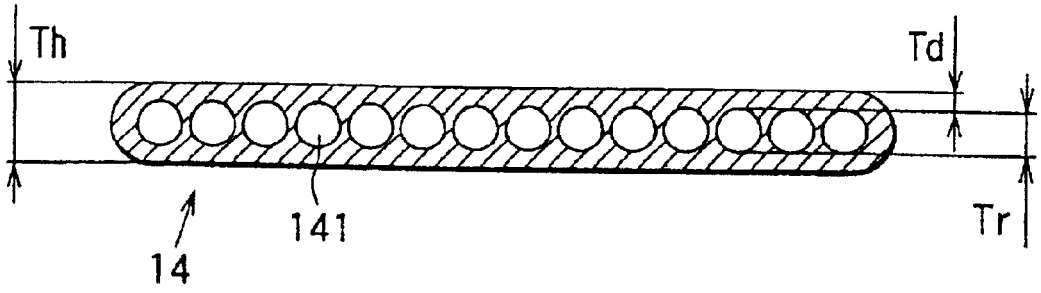
FIG. 2 is a cross-sectional view taken along line II—II in FIG. 1.
Figure 3:
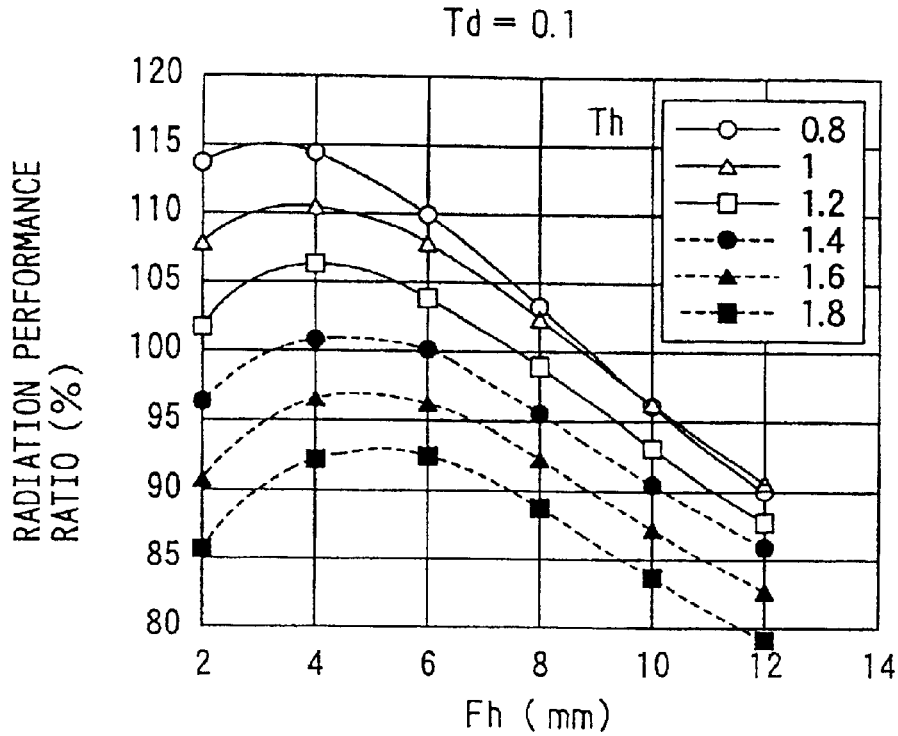
FIG. 3 is a graph showing a relation between fin height Fh and radiation performance (Td=0.1 mm)
Figure 4:
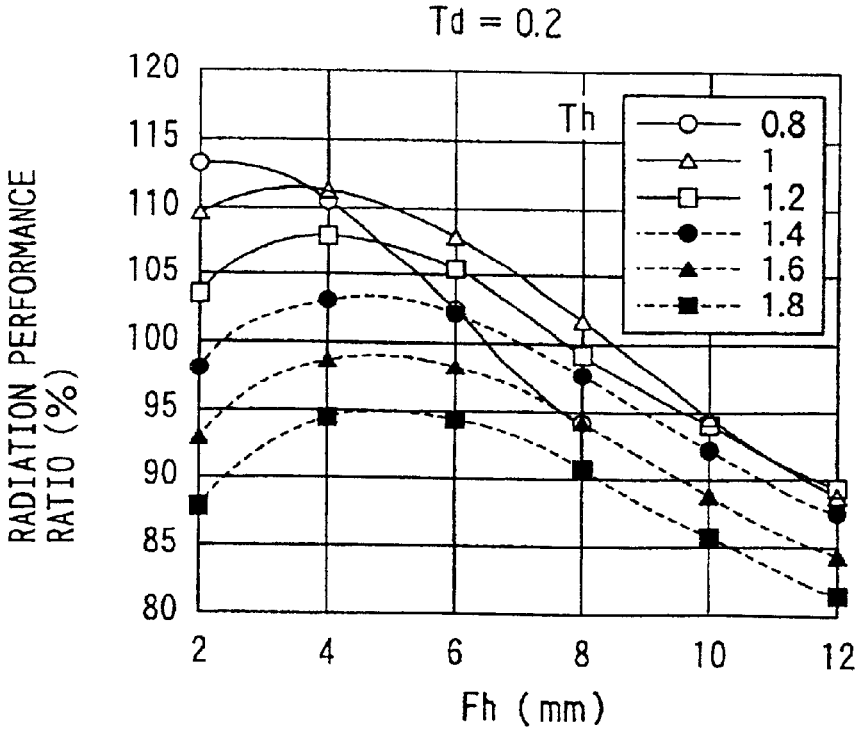
FIG. 4 is a graph showing a relation between fin height Fh and radiation performance (Td=0.2 mm)
Figure 5:
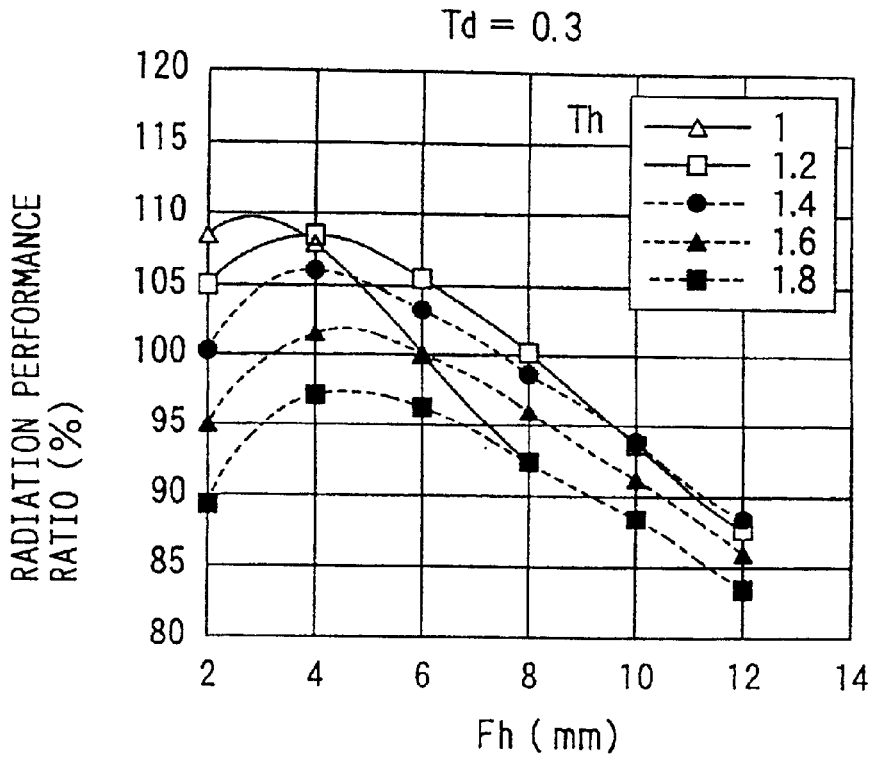
FIG. 5 is a graph showing a relation between fin height Fh and radiation performance (Td=0.3 mm)
Figure 6:
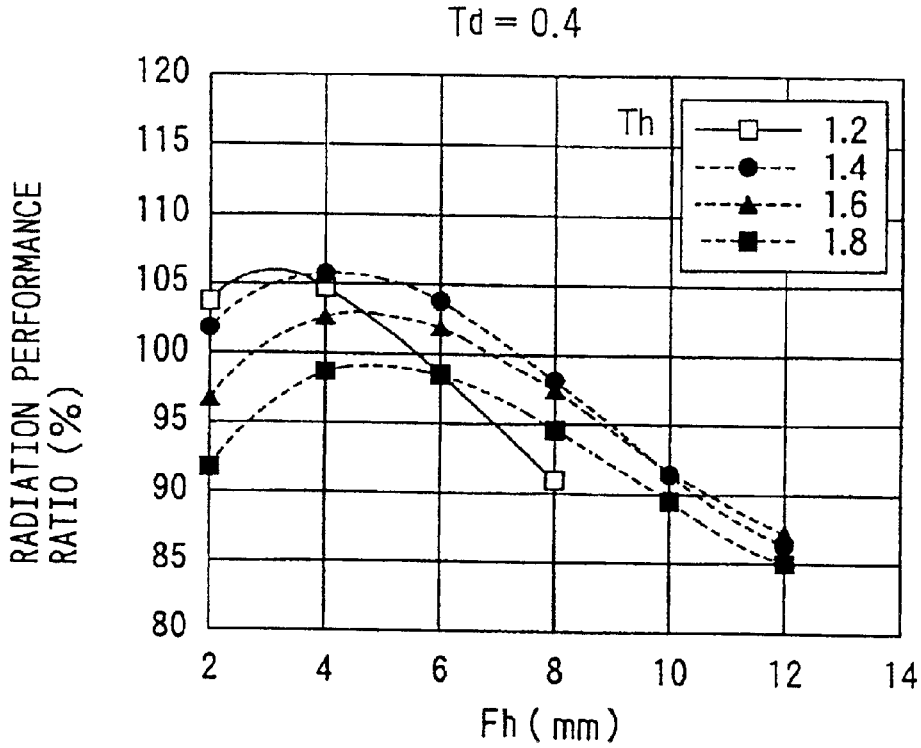
FIG. 6 is a graph showing a relation between fin height Fh and radiation performance (Td=0.4 mm)

As shown in FIG. 2, the flat tube 14 includes a plurality of circle refrigerant passages 141, and is made by extrusion. One end of the flat tube 14 connects with the first header tank 11, and the other end of the flat tube 14 connects with the second header tank 12. Therefore, the first tank 11 communicates with the second header tank 12 through the flat tube 14.

A separator 16 is provided inside the first tank 11 to divide the inside of the first tank 11 into an upper chamber 17 and a lower chamber 18. The gas refrigerant discharged from the compressor flows into the upper chamber 17. The gas refrigerant flows through some of the flat tubes 14 communicating with the upper chamber 17, and flows into the second header tank 12. The refrigerant U-turns in the second header tank 12, and flows through the remaining flat tubes 14 and into the lower chamber 18. The gas refrigerant heat-exchanges with air passing through between each of flat tubes 14 to be cooled and condensed. In this way, the refrigerant is condensed to be gas-liquid two-phase refrigerant.

Next, a radiation performance simulation result of the condenser 10 will be explained.

The simulation was done under the following state;

Core portion height H=300 mm, Core portion width W=600 mm, Fin pitch Fp=3 mm, Air flow speed at condenser inlet is 2 m/s, Air temperature at condenser inlet is 35° C., Refrigerant pressure at condenser inlet is 1.74 MPa (abs), Super heat at condenser inlet is 20° C., Dryness at condenser outlet is 0 (zero), Sub-cool at condenser outlet is 0° C.

In this simulation, parameters are Tube height Th, Tube outer periphery thickness Td, and Fin height Fh. The tube height Th is a height of the flat tube 14 in the tube laminating direction. The tube outer periphery thickness Td is a tube laminating direction dimension between the outer surface of the flat tube 14 and the top of the refrigerant passage 141. The fin height Fh is a height of the corrugate fin 15 in the tube laminating direction. The simulation calculates a radiation amount of the condenser 10 while considering air low resistance and pressure loss inside the tube 14.

1. Tube Inside Passage Height Tr Examination:

FIGS. 3–6 are graphs showing relations between Fin height Fh and radiation performance at Td=0.1 mm, 0.2 mm, 0.3 mm, and 0.4 mm, respectively. The simulations were done by setting the Tube height Th every 0.2 mm within a range of 0.8–1.8 mm, and by setting Fin height Fh every 2 mm within a range of 4–12 mm. Here, according to the condenser 10 used for the simulation, Core portion height H=300 mm, Core portion width W=600 mm, Fin pitch Fp=3.2 mm, Tube height Th=1.7 mm, and Tube outer periphery thickness Fd=0.35 mm. As is understood from FIGS. 3–6, the radiation performance is the maximum when Fh is set around 4 mm regardless of Td and Th.

Figure 7:
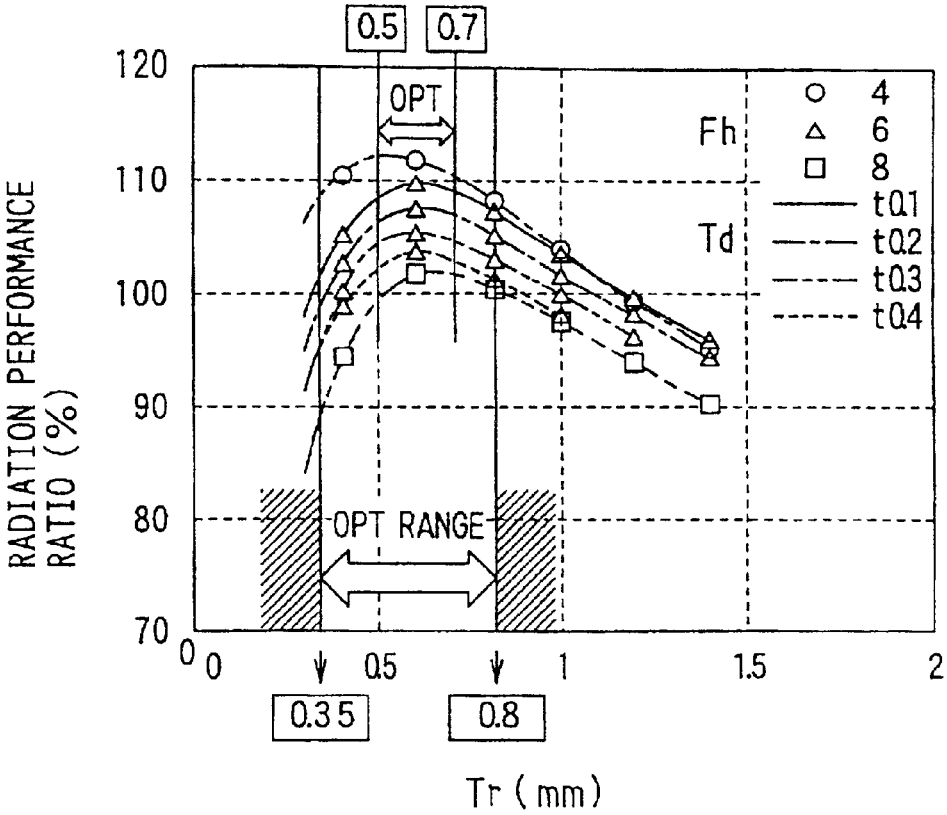
FIG. 7 is a graph showing a relation between tube inside passage height Tr and radiation performance.
Figure 8:
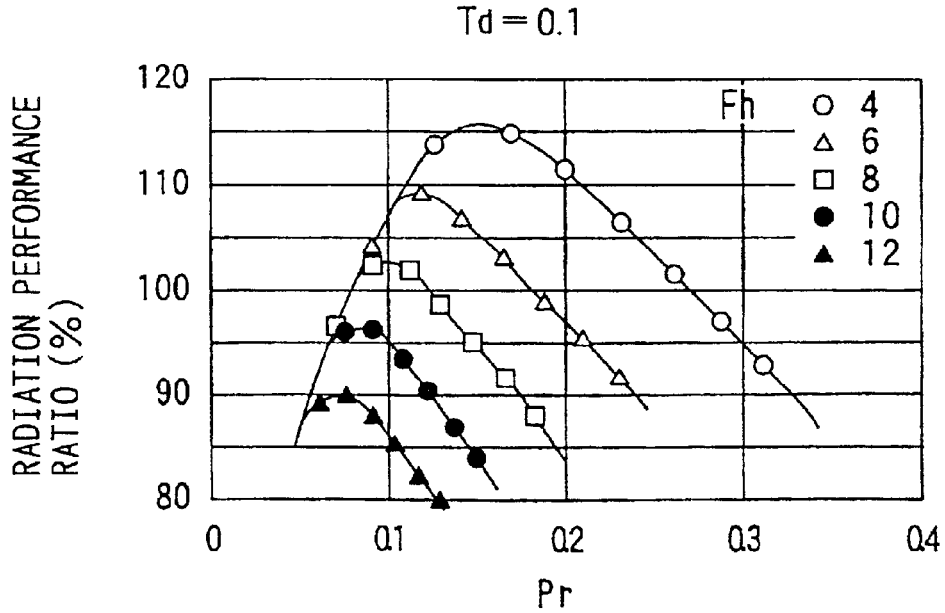
FIG. 8 is a graph showing a relation between air flow opening ration Pr and radiation performance (Td=0.1 mm)
Figure 9:
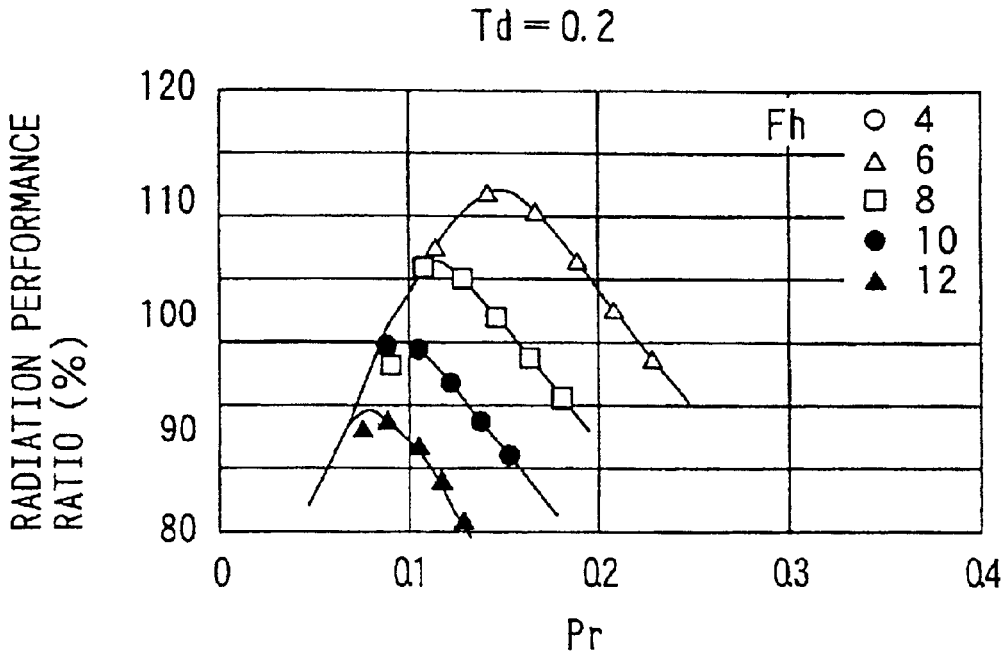
FIG. 9 is a graph showing a relation between air flow opening ration Pr and radiation performance (Td=0.2 mm)
Figure 10:
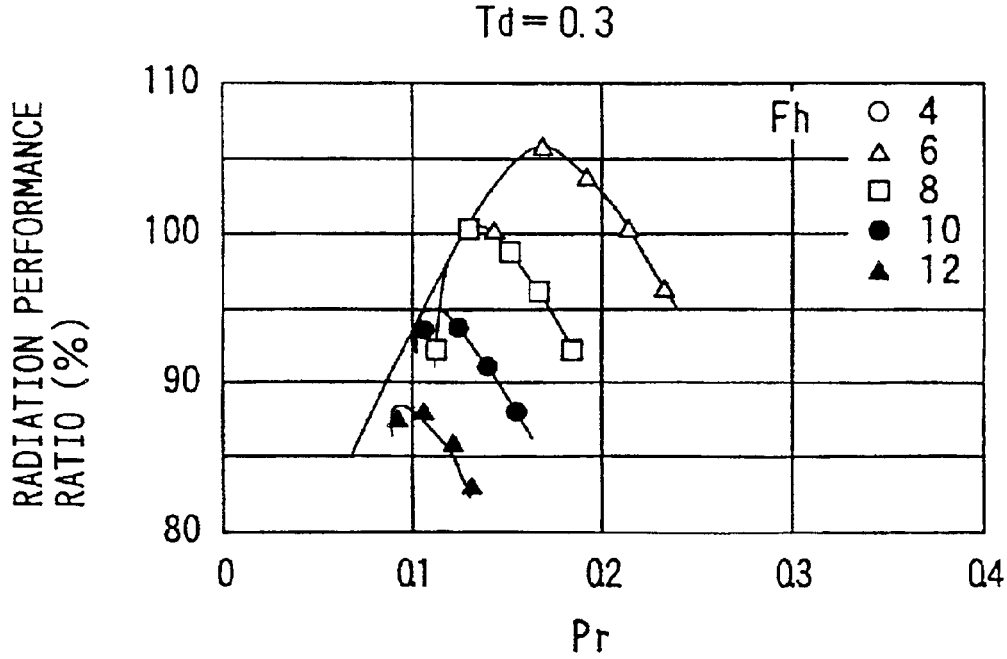
FIG. 10 is a graph showing a relation between air flow opening ration Pr and radiation performance (Td=0.3 mm)
Figure 11:
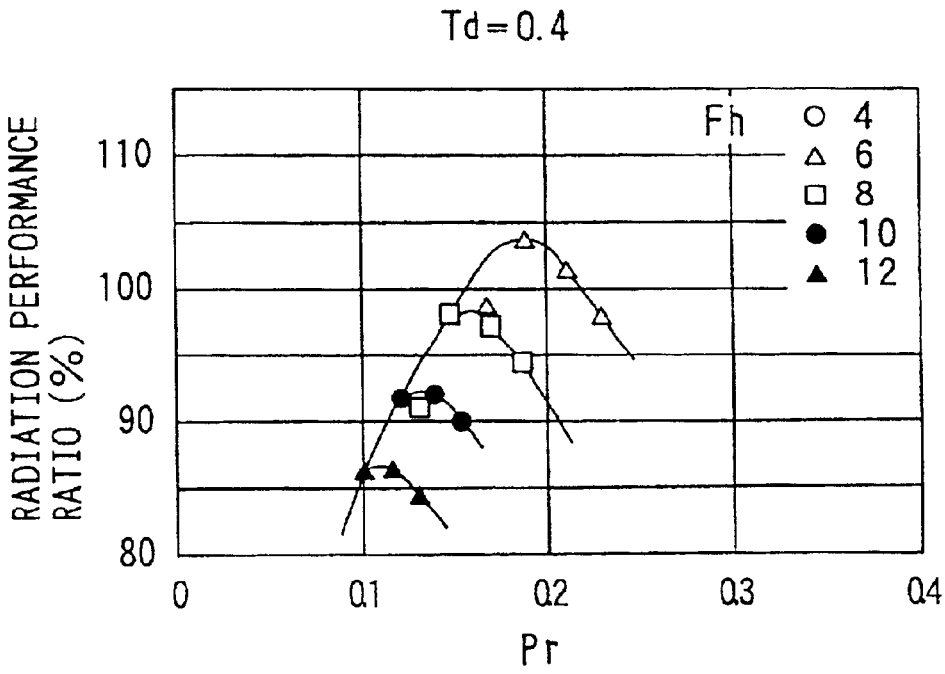
FIG. 11 is a graph showing a relation between air flow opening ration Pr and radiation performance (Td=0.4 mm)

FIG. 7 is a graph showing a relation between tube inside passage height Tr and radiation performance including the results of FIGS. 3–6 while paying attention to tube inside passage height Tr influencing on the air flow resistance and tube inside pressure loss. Here, the tube inside passage height Tr=Th−2×Td. That is, the tube inside passage height Tr is a height of the refrigerant passage 141 in the laminating direction of the flat tube 14.

As is understood from FIG. 7, the radiation performance is high when Tr is set within a range of 0.35 mm–0.8 mm regardless of Td and Fh. Especially, radiation performance becomes the maximum when Tr is set within a range 0.5 mm–0.7 mm.

Here, when Tr is set under 0.35 mm, radiation performance is abruptly reduced, because the cross sectional area of the refrigerant passage is reduced and the pressure loss inside passage increases. Likewise, when Tr is set over 0.8 mm, the radiation performance is reduced, because an air flow area is reduced due to an increasing of Tr and the air flow resistance is increased. Therefore, it is desired to set Tr within a range of 0.35 mm–0.8 mm to minimize sum of radiation performance reduction due to the pressure loss inside passage and radiation performance reduction due to the air flow resistance, for attaining high radiation performance.

2. Air Flow Opening Ratio Examination:

FIGS. 8–11 are graphs showing relations between Air flow opening ratio Pr and radiation performance at Td=0.1 mm, Td=0.2 mm, Td=0.3 mm, and Td=0.4 mm, respectively, which include the results of FIGS. 3–6 while paying attention to the Air flow opening ratio Pr influencing on the air flow resistance and the pressure loss inside passage. Here, the air flow opening ratio Pr=Th/Tp. The tube pitch Tp is an interval between each of the adjacent flat tubes 14 in the tube laminating direction.

Figure 12:
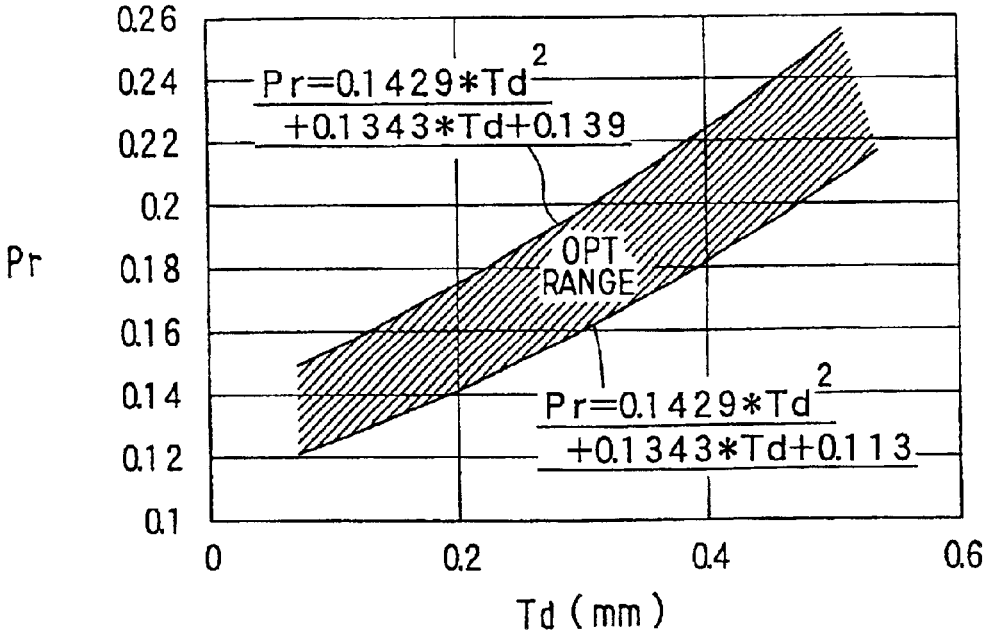
FIG. 12 is a graph showing a relation tube outer periphery thickness Td and air flow opening ratio Pr.

FIG. 12 is a graph showing a relation between Air flow opening ratio Pr and radiation performance, and showing an optimum Pr range. The optimum Pr range was obtained by attaining Pr range where radiation performance is high, at every tube outer periphery thickness Td (0.1 mm, 0.2 mm, 0.3 mm, 0.4 mm), based on FIGS. 8–11. The optimum Pr range is expressed by following formula expression. Here, the unit of tube outer periphery thickness Td is "mm".

$$0.1429\times Td^2+0.1343\times Td+0.139\geqq Pr\geqq 0.1429\times Td^2+0.1343\times Td+0.113$$

Therefore, when the tube inside passage height Tr is set within a range 0.35 mm≦Tr≦0.8 mm (especially 0.5 mm≦Tr≦0.7 mm) and the air flow opening ratio Pr is set in accordance with the formula expression, high radiation performance can be attained.

(Modifications)

According to the above-described embodiment, the flat tube 14 including circle refrigerant passages 141 is formed by extrusion. Alternatively, the present invention may be applied to miscellaneous tubes shown in FIGS. 13A–13F.

Figure 13A:
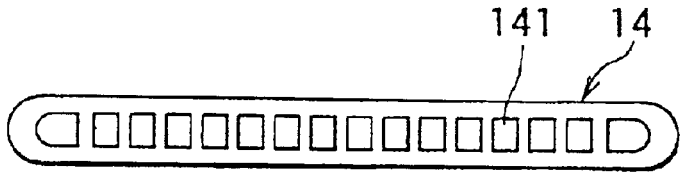
FIGS. 13A–13F are cross sectional view showing miscellaneous tubes according to modifications.

A flat tube 14 shown in FIG. 13A includes a plurality of rectangular refrigerant passages 141, and is made by extrusion.

Figure 13B:
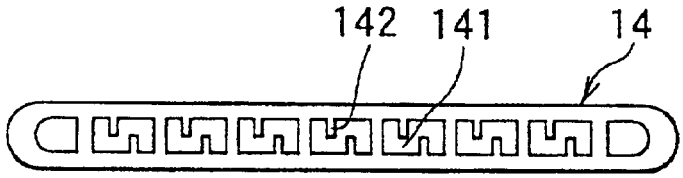

A flat tube shown in FIG. 13B includes a plurality of projections 142 protruding toward the inside of the refrigerant passage 141, and is made by extrusion.

Figure 13C:
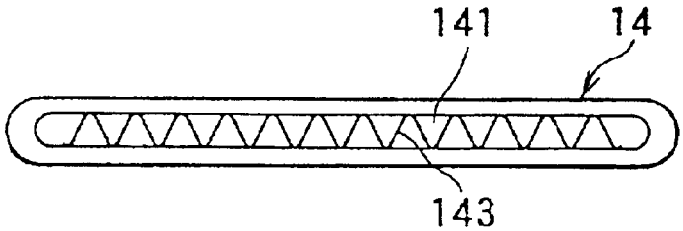

A flat tube 14 shown in FIG. 13C is an electro-rasistance-welded tube made by cylindrically bending a metal rectangular plate and welding both facing ends of the bent metal plate each other, and includes a single refrigerant passage 141. An inner fin 143 is provided in the refrigerant passage 141.

Figure 13D:
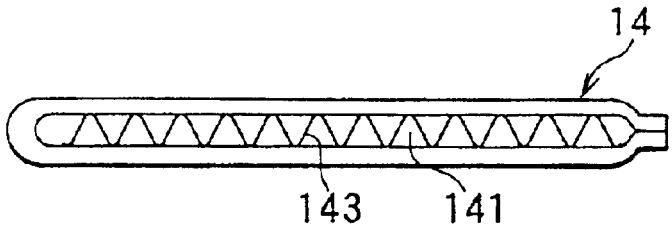

A flat tube 14 shown in FIG. 13D is made by bending a metal plate and brazing both ends to each other, and includes a single refrigerant passage 141. An inner fin 143 is provided in the refrigerant passage 141. Here, straight inner fin or offset inner fin may be used for the inner fins 143 shown in FIGS. 13C and 13D.

Figure 13E:
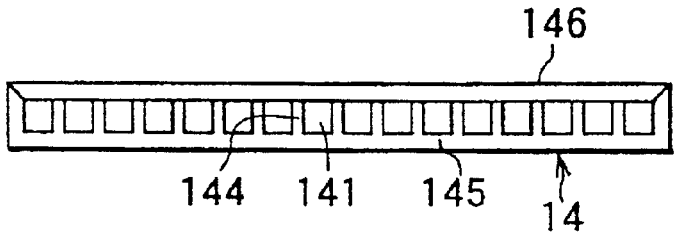

A flat tube 14 shown in FIG. 13E includes a first plate 145 and a second plate 146 brazed to the first plate 145. The first plate 145 includes a plurality of roller-formed or press-formed ribs 144.

Figure 13F:
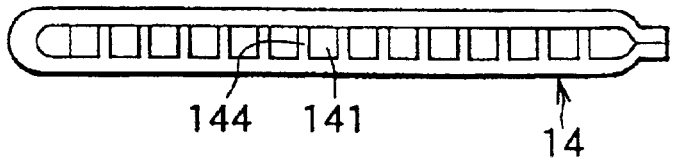

A flat tube 14 shown in FIG. 13F is formed by bending a metal plate including a plurality of roller-formed or press-formed rib 144, and brazing both ends to each other. Here, straight rib extending in a refrigerant flow direction or cross rib extending diagonally with respect to the refrigerant flow direction may be used for the rib 114 shown in FIGS. 13E and 13F.

What is claimed is:

1. A refrigerant condenser comprising:

a plurality of tubes including refrigerant passages therein, said tubes being laminated;

a fin disposed in an air flow passage defined between each of the adjacent tubes; and header tanks disposed at both longitudinal ends of said tubes and communicating with said refrigerant passage, wherein said refrigerant passage defines a height thereof in a tube lamination direction as a tube inside passage height (Tr), and the tube inside passage height (Tr) is set within a range of 0.5–0.7 mm; wherein a dimension between an outer surface of said tube and a top of said refrigerant passage in the tube lamination direction is defined as a tube outer periphery thickness Td, the tube outer periphery thickness Td is set no greater than 0.3 mm, a height of said tubs in the tube lamination direction is defined as tube height Th, an interval between each of the adjacent tubes is defined as tube pitch Tp, a ratio of the tube height Th to the tube pitch Tp (Th/Tp) is defined as air flow opening ratio (Pr), and the air flow opening ratio (Pr) is set in accordance with following formula expression, $$0.1429\times Td^2+0.1343\times Td+0.139\geqq Pr\geqq 0.1429\times Td^2+0.1343\times Td+0.113.$$

2. The refrigerant condenser according to claim 1, wherein each of the refrigerant passages is formed in a circle cross-section.

3. The refrigerant condenser according to claim 2, wherein the tube is made by extrusion process.

4. The refrigerant condenser according to claim 3, wherein the tube is made of aluminum.

5. The refrigerant condenser according to claim 1, wherein the tube is made by extrusion process.

6. The refrigerant condenser according to claim 1, wherein at least a part of the refrigerant passages has a rectangular shape in cross-section, and a vertical dimension is larger than a horizontal dimension in each rectangular shape.

7. The refrigerant condenser according to claim 1, wherein the tube includes therein an inner fin having a wave shape, and the refrigerant passages in each tube are partitioned from each other by the inner fin.

8. The refrigerant condenser according to claim 1, wherein at least a part of the refrigerant passages has a round shape in cross-section.

9. The refrigerant condenser according to claim 1, wherein the tube outer periphery thickness Td is in a range between 0.1 mm and 0.3 mm.

* * * * *